United States Patent [19]

Suzuki

[11] 4,445,554

[45] May 1, 1984

[54] LOG SPLITTER

[75] Inventor: Yasunori Suzuki, Fujinomiya, Japan

[73] Assignee: Yasui Sangyo Co., Ltd., Fujinomiya, Japan

[21] Appl. No.: 309,940

[22] Filed: Oct. 9, 1981

[51] Int. Cl.[3] ..... B27L 7/00

[52] U.S. Cl. ..... 144/193 A; 60/479; 60/486; 254/93 H

[58] Field of Search ..... 254/93 H; 60/479, 486; 144/193 A

[56] References Cited

U.S. PATENT DOCUMENTS 4,284,113 8/1981 Nordlin ..... 144/193 A

*Primary Examiner*—W. D. Bray

*Attorney, Agent, or Firm*—Zarley, McKee, Thomte, Voorhees & Sease

[57] ABSTRACT

A log splitter wherein a wedge having a cutting edge and a hydraulic power unit are arranged on one and the other ends of an I beam horizontally supported by supports, is disclosed. A log to be split is placed on the I beam between the wedge and the hydraulic power unit and is pushed towards the wedge by a ram of the hydraulic power unit. The hydraulic power unit is actuated by either air pump means or manual pump means, or by both the two means in the same time.

2 Claims, 6 Drawing Figures

LOG SPLITTER

BACKGROUND OF THE INVENTION

This invention relates to a log splitter, and more particularly relates to a log splitter of the type which is operated mutually and hydraulically by using air pump means.

In a conventional log splitter, the hydraulic cylinder means for advancing a ram is actuated by an internal combustion engine or an electric motor. However, in this case, the moving speed of the ram of the hydraulic cylinder means is fixed, and usually it is slow even though the moving speed can be changed to a low or high speed by changing the pressure applied to the hydraulic cylinder means. Further, when a knife edge of a wedge is penetrated into one end of a timber to be split by the ram, a rather heavy load should be added to the ram, and thus this operation is often aided by hands, or the larger drive means is required, otherwise the drive means is stopped or overheated by the overload.

SUMMARY OF THE INVENTION

It is an object of the present invention to provide a log splitter free from the aforementioned inconveniences, which is simple, safe and operative, and which is capable of performing a quick and reliable operation.

According to the present invention there is provided a log splitter wherein a wedge having a cutting edge and a hydraulic power unit are arranged on one and the other ends of an I beam horizontally supported by supports, and a log placed on the I beam between the wedge and the hydraulic power unit is to be split by pushing the log to the wedge by a ram of the hydraulic power unit, the improvement comprising air pump means and manual pump means which actuate the hydraulic power unit so as to extend the ram forward.

BRIEF DESCRIPTION OF DRAWINGS

In order that the present invention may be better understood, a preferred embodiment thereof will be described with reference to the accompanying drawings, in which.

DESCRIPTION OF A PREFERRED EMBODIMENT

Figure 1:
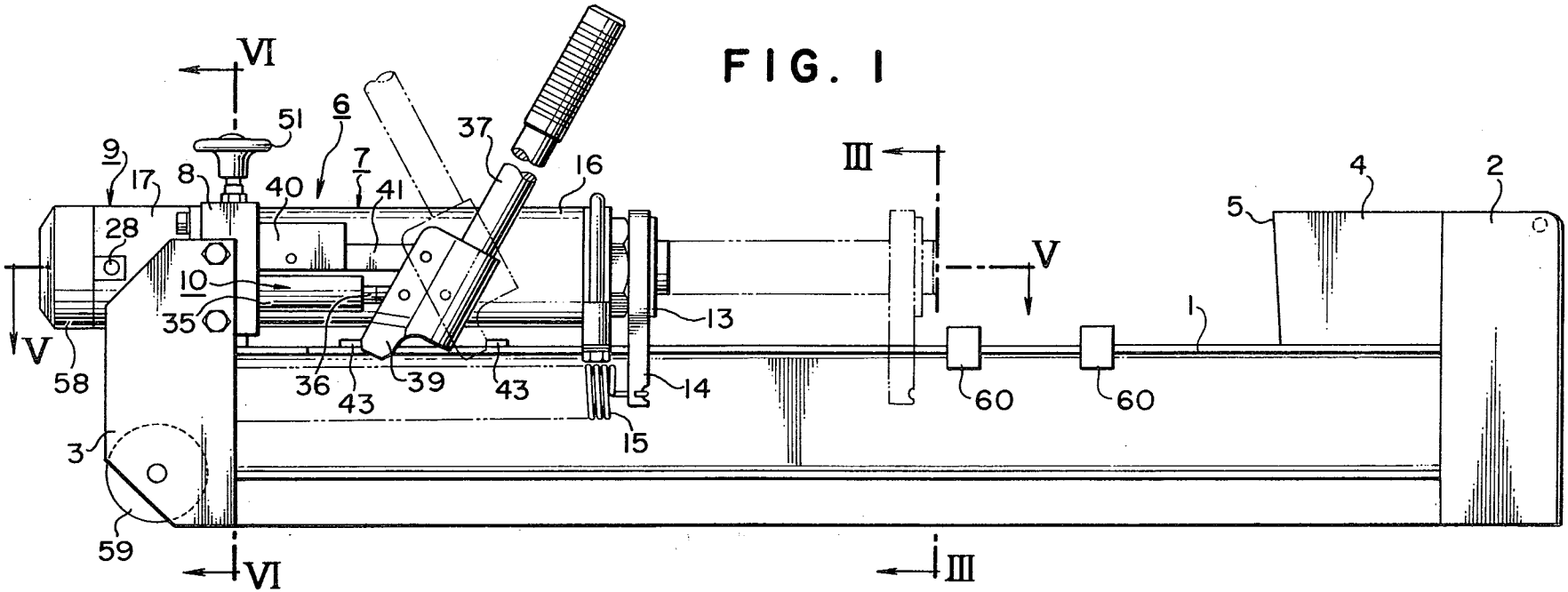
FIG. 1 is an elevational view of a log splitter according to the present invention.
Figure 2:
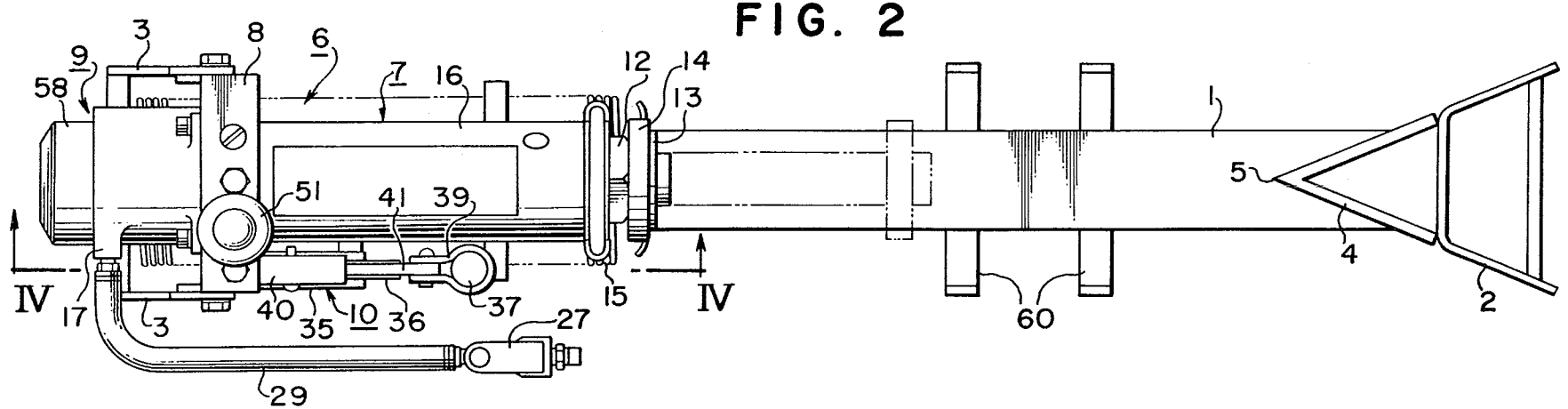
FIG. 2 is a plan view of FIG. 1.
Figure 3:
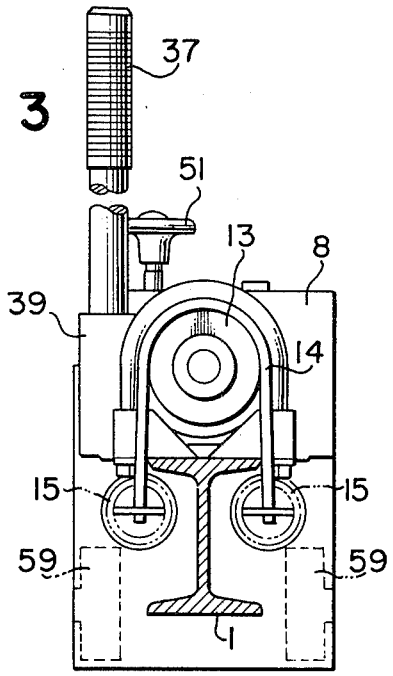
FIG. 3 is a longitudinal cross-section, taken along the line III—III of FIG. 1.
Figure 6:
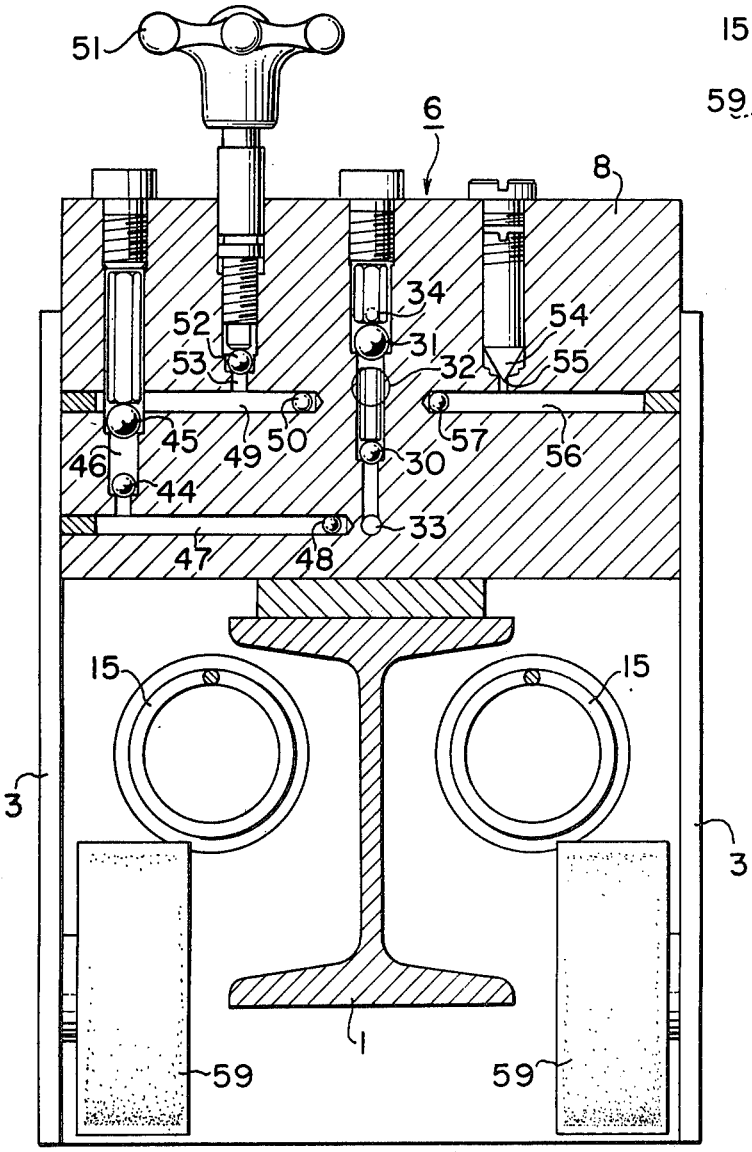
FIG. 6 is an enlarged longitudinal cross-section, taken along the line VI—VI of FIG. 1.
Figure 4:
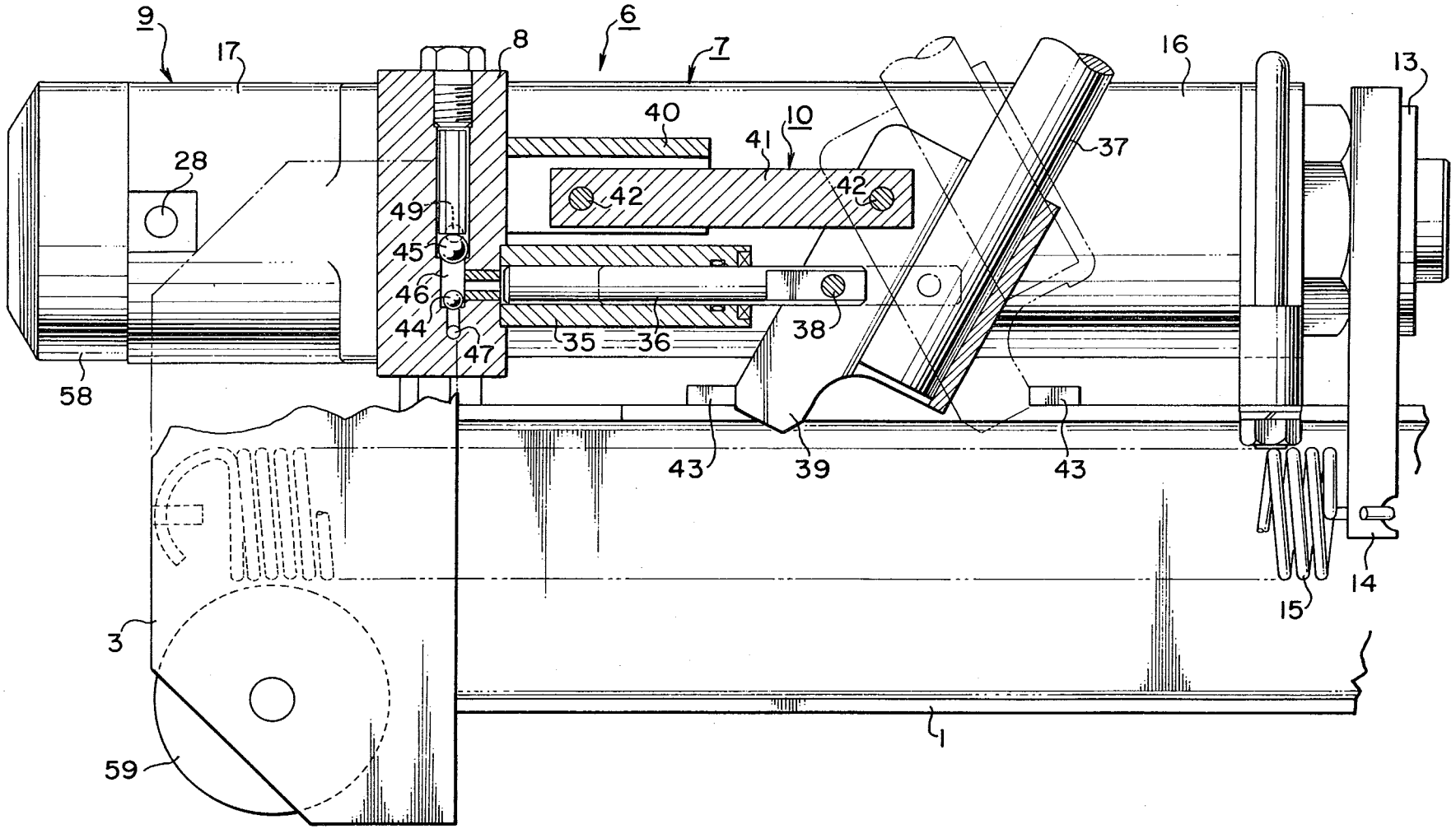
FIG. 4 is an enlarged longitudinal cross-section, taken along the line IV—IV of FIG. 2, of a hydraulic power unit of the log splitter of FIG. 1.
Figure 5:
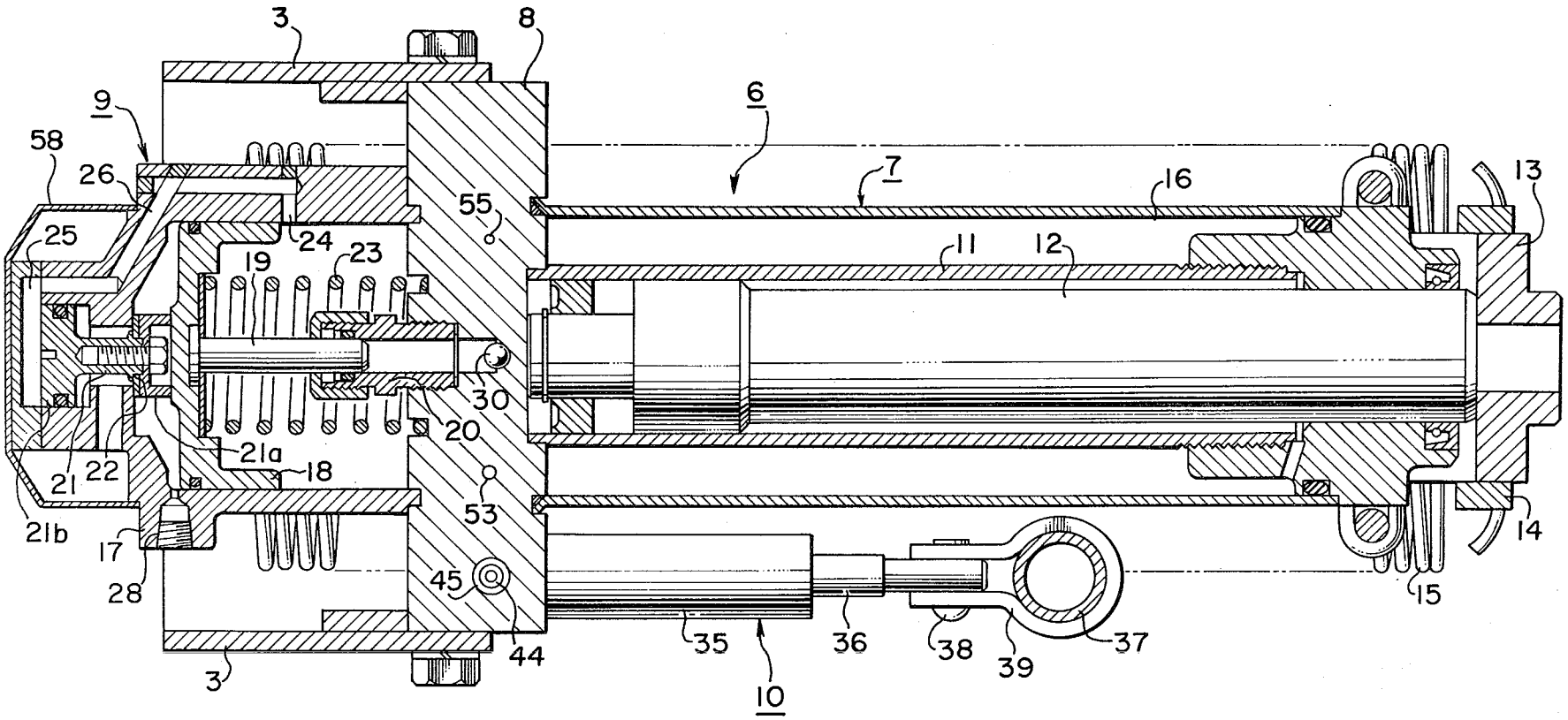
FIG. 5 is an enlarged transverse cross-section, taken along the line V—V of FIG. 1, of the hydraulic power unit of FIG. 4.

Referring now to the drawings there is shown in FIGS. 1-6 a log splitter according to the present invention.

An I beam 1 having a I-shaped cross-section is horizontally supported by front and rear support members in its front and rear ends on the ground, the front support member comprising an angular support 2 having a horizontal trapezoidal cross-section spreading frontward and the rear support member comprising a pair of support plate legs 3 whose upper and lower rear corners are diagonally cut off. A wedge 4 is mounted in the front end of the I beam 1 behind the angular support 2, and it is integrally provided with a cutting edge 5 in its rear end. The edge 5 is sharpened and its top slants somewhat rearwards so that it may readily penetrate into one end of a log to be split. The wedge 4 and the angular support 2 constitute a V-shaped wedge construction.

A hydraulic power unit 6 is disposed on the I beam 1 in its rear end between the support plate legs 3, and comprises a cylinder means 7 in its front, an oil box 8 in its middle, an air pump means 9 in its rear, and a manual pump cylinder means 10 in its one side.

The cylinder means 7 comprises a cylinder 11 and a ram 12 which is reciprocally mounted therein and is moved frontward and rearward, i.e. toward and away from the wedge 4 along the longitudinal direction of the I beam 1. On the free end of the ram 12 a ram pad 13 is mounted and directly contacts the log placed on the I beam 1. A U-shaped hook 14 is secured to the ram pad 13 around its half periphery. A pair of return springs 15 are connected between the free ends of the hook 14 and the rear ends of the legs 3, and they bias the ram 12 to its retracted position, i.e. the rearward. The cylinder 11 is surrounded by an oil tank 16 in which the oil for pushing the ram 12 is enclosed.

The air pump means 9 comprises an air cylinder 17, an air piston 18 reciprocally mounted therein, a plunger rod 19, the rear end of which is mounted to the inner rear end of the air piston 18 and is moved reciprocally together therewith, a hydraulic pump cylinder 20, mounted to the oil box 8, in which the free end of the plunger rod 19 moves reciprocally, and a servo valve 21 including a front disk **21*a* and a rear disk 21*b* having a larger diameter than that of the front disk 21*a*, the front disk 21*a* opening or closing an outlet 22 formed in the rear of the air cylinder 17**.

The air piston 18 is biased rearward by a spring 23 fitted between the rear end of the air piston 18 and the oil box 8, and thus the rear end of the air piston 18 biases the front disk **21*a* of the servo valve 21 onto the outlet 22 of the air cylinder 17, so that the servo valve 21 may close up the outlet 22 of the air cylinder 17**.

The air cylinder is provided with a by-pass hole 24 in its side wall and a rear chamber 25 in its rear, and the by-pass hole 24 and the rear chamber 25 are connected each other by a by-pass path 26. The rear chamber 25 is biased to be closed by the rear disk **21*b* of the servo valve 21 when the front disk 21*a* closes the outlet 22 of the air cylinder 17. An air valve 27 leading to an air compressor (not shown) is connected to an air inlet 28 of the air cylinder 17 through an air hose 29**.

The hydraulic pump cylinder 20 leads to an inhalation valve 30 and an exhaust valve 31 formed in the middle of the oil box 8, via a common path 34. The inhalation valve 30 and the exhaust valve 31 are connected to the oil tank 16 and the cylinder 11 of the cylinder means 7 via an inhalation path 33 and an exhaust path 34, respectively.

The manual pump cylinder means 10 comprises a pump cylinder 35 mounted to one side of the oil box 8, a plunger 36 which is reciprocally mounted in the pump cylinder 35, and a handle 37 which is pivotally mounted to the free end of the plunger 36 through a pivot pin 38, a handle socket 39 which is pivotally mounted to a bracket 49 secured to the oil box 8, via a link bar 41 and pivot pins 42. The pivot motion of the handle socket 39 and thus the handle 37 is limited by stop bars 43 mounted to the I beam 1.

The pump cylinder 35 leads to an inhalation valve 44 and an exhaust valve 45 formed in the one side of the oil box 8 via a common path 46. The inhalation valve 44 and the exhaust valve 45 are connected to the oil tank 16 and the cylinder 11 of the cylinder means 7 via inhalation paths 47 and 48 and exhaust paths 49 and 50, respectively.

Now, when the compressed air is supplied in the air cylinder 17 from the compressor via the air valve 27, the air hose 29 and the air inlet 28, the compressed air advances the air piston 18 forward, and thus the plunger rod 19 pushes out the oil in the hydraulic pump cylinder 20 into the cylinder 11 of the cylinder means 7 through the exhaust valve 31 and the exhaust path 34, while the inhalation valve 30 is closed. Accordingly, the ram 12 is advanced so as to push the log towards the wedge 4.

When the air piston 18 is moved forward passing through the by-pass hole 24, the compressed air passes into the rear chamber 25 through the by-pass hole 24 and by-pass path 26, and pushes the rear disk **21*b* of the servo valve 21 frontward. As soon as the servo valve 21 is moved frontward and the outlet 22 of the air cylinder 17 is opened, the compressed air in the air cylinder 17 is discharged to the atmosphere through the opened outlet 22. Then, the air piston 18 is returned rearward to the contracted position by the spring 23, and the air piston 18 pushes the front disk 21*a* of the servo valve 21 rearward to close the outlet 22 of the air cylinder 21. In the same time, the plunger rod 19 is returned rearward together with the air piston 18, and the oil is sucked from the oil tank 16 into the hydraulic pump cylinder 20 via the inhalation valve 30 and the inhalation path 33, while the exhaust valve 31** is closed.

This operation is repeated automatically when the compressed air is supplied into the air cylinder 17, thereby advancing the ram 12 towards the wedge 4.

Alternatively, the ram 12 can be manually advanced by pivoting the handle 37. That is, the plunger 36 is reciprocally moved by pivoting the handle 37. When the plunger 36 is extended from the pump cylinder 35, the oil is sucked from the oil tank 16 into the pump cylinder 35 via the inhalation valve 44 and the inhalation paths 47 and 48, while the exhaust valve 45 is closed, and, on the other hand, when the plunger 36 is contracted into the pump cylinder 35, the oil is pushed out by the plunger 36 from the pump cylinder 35 into the cylinder 11 of the cylinder means 7 via the exhaust valve 45 and the exhaust paths 49 and 50, while the inhalation valve 44 is closed, thereby advancing the ram 12 towards the wedge 4, in the same manner as the air pump means 9.

The oil box 8 is provided with a release handle 51 and a release valve 52 which is connected to the exhaust path 49 via a release path 53. The release valve 52 is opened by rotating the release handle 51, so that the oil in the cylinder 11 of the cylinder means 7 may be released to send it back to the oil tank 16 through a return path by the forces of the springs 15.

The oil box 8 is also provided with a safety valve 54 which is connected to the cylinder 11 of the cylinder means 7 via paths 55–57. When the overload is added to the ram 12, the safety valve 54 is automatically opened so as to release the oil in the cylinder 11 to the oil tank 16.

A muffler 58 covers the rear of the air cylinder 17 for reducing the noise of the compressed air exhausting through the outlet 22 of the air cylinder 17.

A pair of wheels 59 are rotatably mounted onto the inside of the support legs 3 so that the bottoms of the wheels 59 may be slightly higher than the bottom of the support legs 3. Hence, when the front support 2 is lifted, the wheels 59 are contacted with the ground and support the log splitter. In this state, the log splitter can be moved readily.

A pair of log holders 60 may be mounted across the I beam 1 in the middle part thereof.

In the embodiment described above, the ram 12 can be advanced towards the wedge 4 by using not only either the air pump means 9 or the manual pump cylinder means 10 but also both these means in the same time.

In this embodiment, when the ram 12 is advanced by the air pump means 9, the moving speed of the ram 12 depends on the load added to the ram 12. Hence, after the penetration of the cutting edge 5 of the wedge 4 into the one end of the log to be split, the operation can be performed quickly and automatically since no overload is added to the ram 12 without using a moving speed change means of the ram.

If the overload is added to the ram 12, the movement of the air pump means 9 is stopped and, as occasion demands, a safety device (not shown) attached to the air valve 27 or the compressor is automatically actuated to release the compressed air thereof to the atmosphere, which is safe and reliable. When the overload is added to the ram 12, the hydraulic power unit 6 can be operated manually, as described above, for example, when the cutting edge 5 of the wedge 4 is penetrated into the one end of the log to be split, and the like.

Although the present invention has been described with reference to a preferred embodiment thereof, various changes and modifications can be made by those skilled in the art without departing from the scope of the present invention.

What is claimed is:

1. A log splitter wherein a wedge having a cutting edge and a hydraulic power unit are arranged on one end and the other ends of an I beam, and a log placed on the I beam between the wedge and the hydraulic power unit is split by pushing the log to the wedge by a ram of the hydraulic power unit, the improvement comprising, a mechanically powered pump means and a manual group means operatively connected to each other and to said hydraulic power unit to actuate said hydraulic power unit so as to extend the ram towards said wedge.

2. A log splitter as defined in claim 1 wherein control means is operatively connected to said mechanically powerd pump means and said manual pump means to permit said hydraulic power unit to be actuated by either the combinmed or individual function of said mechanically powered pump means and said manual pump means.

* * * * *